US005875494A

United States Patent [19]

Garnier, Jr. et al.

[11] Patent Number: 5,875,494

[45] Date of Patent: Mar. 2, 1999

[54] HEADWEAR WITH CLOSABLE HAIR OPENING

[76] Inventors: Winslow J. Garnier, Jr., 14383 Trailwind Rd., Poway, Calif. 92064; Patricia J. Bradley, 12051 Alta Carmel Ct., #202, San Diego, Calif. 92128

[21] Appl. No.: 103,773

[22] Filed: Jun. 24, 1998

[51] Int. Cl.[6] ..... A42B 1/04

[52] U.S. Cl. ..... 2/209.7; 2/171.5; 2/195.2; 2/209.3

[58] Field of Search ..... 2/171.4, 171.5, 2/171.7, 195.2, 209.3, 209.7, 417, 418, DIG. 1

[56] References Cited

U.S. PATENT DOCUMENTS

| | | | |
|---|---|---|---|
| 2,673,350 | 3/1954 | Chuck | 2/209.7 |
| 3,041,628 | 7/1962 | Fish et al. . | |
| 4,872,218 | 10/1989 | Holt . | |
| 5,170,509 | 12/1992 | Leopold . | |
| 5,321,854 | 6/1994 | Kronenberger . | |
| 5,509,145 | 4/1996 | Stevenson et al. . | |
| 5,511,249 | 4/1996 | Higgins . | |
| 5,517,695 | 5/1996 | Murray . | |
| 5,535,454 | 7/1996 | Ryan . | |
| 5,539,929 | 7/1996 | Revson . | |
| 5,598,585 | 2/1997 | Stroup . | |
| 5,644,799 | 7/1997 | Armenta et al. . | |

*Primary Examiner*—Diana L. Blefeld
*Attorney, Agent, or Firm*—Tipton L. Randall

[57] ABSTRACT

The invention is a baseball-type cap with a closable opening that extends down the crown seam at the back of the cap. The opening is held closed by means of snaps attached to the overlapping portions of material at the seam edges, and is opened by separating the snaps. The opening extends from the top center of the cap to the rear vent, but does not intersect the adjustment strap opening. This maintains the ability of the cap to be adjusted to fit different head sizes. A wearer can open the closure, allowing a ponytail to extend through it with the cap in place on the wearer's head. The cap functions as normal with the opening snapped shut.

16 Claims, 8 Drawing Sheets

HEADWEAR WITH CLOSABLE HAIR OPENING

FIELD OF THE INVENTION

The invention relates to a head wear item, and more particularly, to a head wear item adapted to accept the hair of a wearer.

BACKGROUND OF THE INVENTION

Longer hair which is tied, braided, or otherwise secured in one or more elongated extensions or "tails" to the back of the head, has long been popular among both women and men. Generally, such hair is pulled together toward the upper back of the scalp, above the location of the rear portion of the band of a hat, cap or other piece of head wear, if such is worn.

The result is that the gathering of the hair near the scalp, which by its nature forms a protruding bundle at that point, must be stuffed under the head wear, with the remainder of the hair extending outwardly and downwardly below the rear edge or band of the head wear. Alternatively, the wearer may bunch up the hair on the top of the wearer's head, and then place the head wear on the head. This is uncomfortable, and the accumulated hair interferes with the placement of the head wear on the wearer's head. With closely fitting caps (e.g., billed or visored "baseball" style caps, etc.) such a configuration can be uncomfortable for the wearer of the headgear. Passing the hair through the opening above the usual adjustment band of such caps provides little additional comfort, as it is generally still too low for optimum positioning relative to the gathered hair at the upper back of the scalp. In cases where hats or caps have a specific, non-adjustable size, there is no such rear opening, which further exacerbates the situation.

Some examples of innovative head wear items to accommodate the hair of the wearer are disclosed by the following patents. Fish et al., in U.S. Pat. No. 3,041,628, discloses a vented cap with a permanent opening at the rear.

Holt, in U.S. Pat. No. 4,872,218, describes a removable cover for an opening between the adjustment strap and the head cover.

Leopold, in U.S. Pat. No. 5,170,509, shows a cap with a rear opening for a ponytail and a hair band fastened at the rear opening.

Kronenberger shows a cap with a rear opening that is adjustable in diameter to accept various sized ponytails in U.S. Pat. No. 5,321,854.

Stevenson et al., in U.S. Pat. No. 5,509,145, disclose a cap with a hole at the top of the crown for accepting a ponytail. The hole has a removable closure that stores inside the cap. A similar cap with one or two holes in the crown for the wearer's ponytail(s) is disclosed by Higgins in U.S. Pat. No. 5,511,249.

Murray, in U.S. Pat. No. 5,517,695, discloses a cap adjustment strap-covering device with various decorative attachments. A protective helmet with a hair entraining aperture is disclosed by Ryan in U.S. Pat. No. 5,535,454.

Revson, in U.S. Pat. No. 5,539,929, discloses a cap with a sealable storage pocket at the rear, adjacent the adjustment strap opening.

In U.S. Pat. No. 5,598,585 Stroup describes a headband with a ponytail holder, the headband having U-shaped ends that fasten around the ponytail.

U.S. Pat. No. 5,644,799 by Armenta et al. shows a cap with a hole in the rear for accepting a ponytail of the wearer.

The hole has a covering that contains a number of slots that are sized to allow passage of the ponytail through the covering, yet grip the hair to hold the cap in place. The slots radiate from a central point in the covering.

Accordingly, an unmet need is seen for a head wear which provides a neat and attractive passage at the upper back portion of the item, for the passage of the hair of a longer hairstyle there through. The head wear should also be usable and attractive for the wearer who does not have an accumulation of long hair at the back of the head. Kronenberger, in U.S. Pat. No. 5,321,854, and Armenta et al., in U.S. Pat. No. 5,644,799, have provided extensive discussions of this topic. The content of these two patents are incorporated herein by reference.

SUMMARY OF THE INVENTION

The invention is a headwear piece comprising a crown defining an opening to accept the head of a wearer and having a front portion and a rear portion. The crown is dimensioned to extend from the back to the front of a wearer's head. The crown has a top and a bottom, a peripheral wall with an annular configuration and a top wall. The crown has at least one unfastened crown seam with overlapping portions. The unfastened crown seam extends from the top wall and through at least a portion of the crown peripheral wall at the rear portion of the crown. Means to reversibly fasten the rear crown seam overlapping portions together is provided. A wearer may insert an accumulation of hair through the unfastened crown seam with the headwear positioned on the wearer's head to comfortably accommodate the wearer's hair.

DESCRIPTION OF THE PREFERRED EMBODIMENTS

Nomenclature

Figure 1:
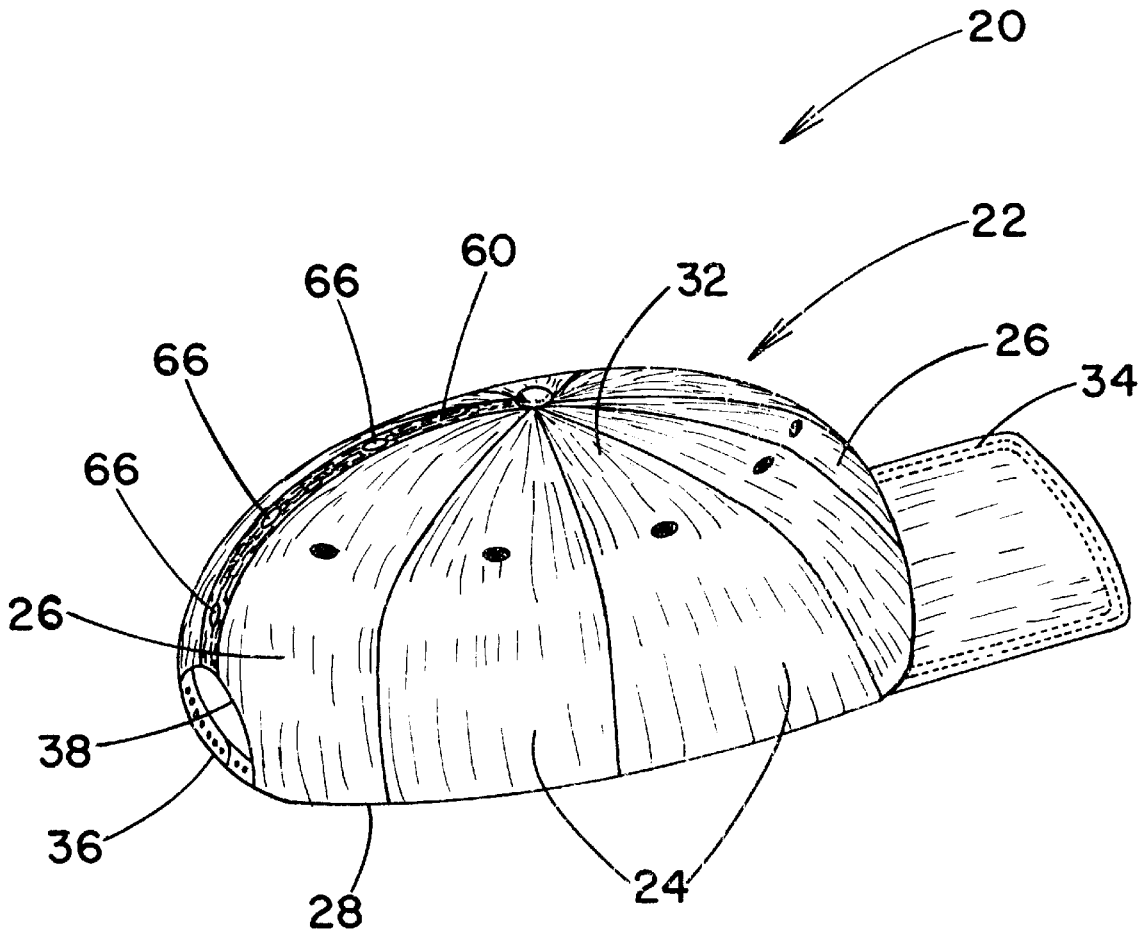
FIG. 1 is a perspective side view of the headwear piece with the rear crown seam closed.
Figure 2:
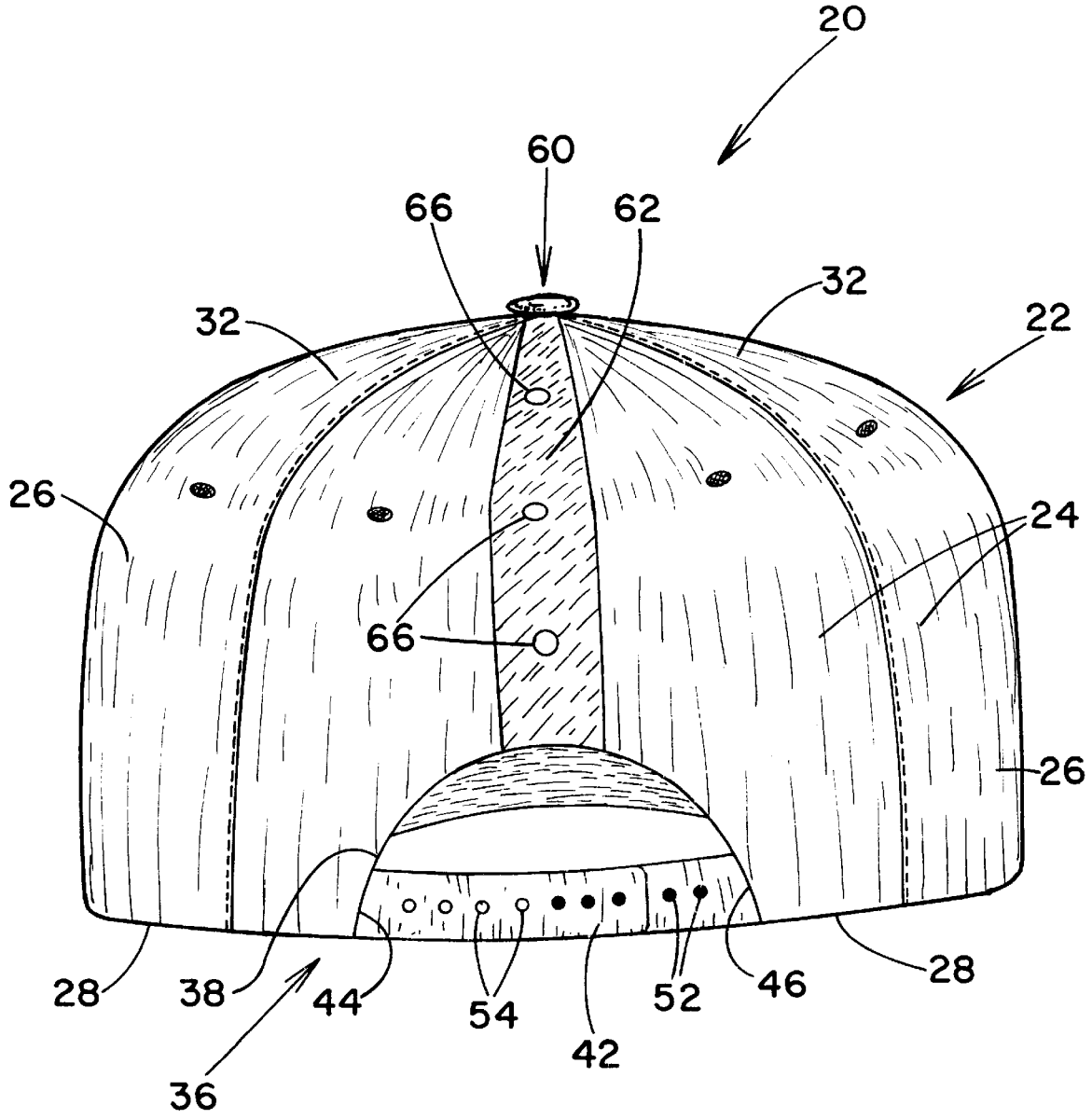
FIG. 2 is a plan rear view of the headwear piece with the rear crown seam closed.
Figure 3:
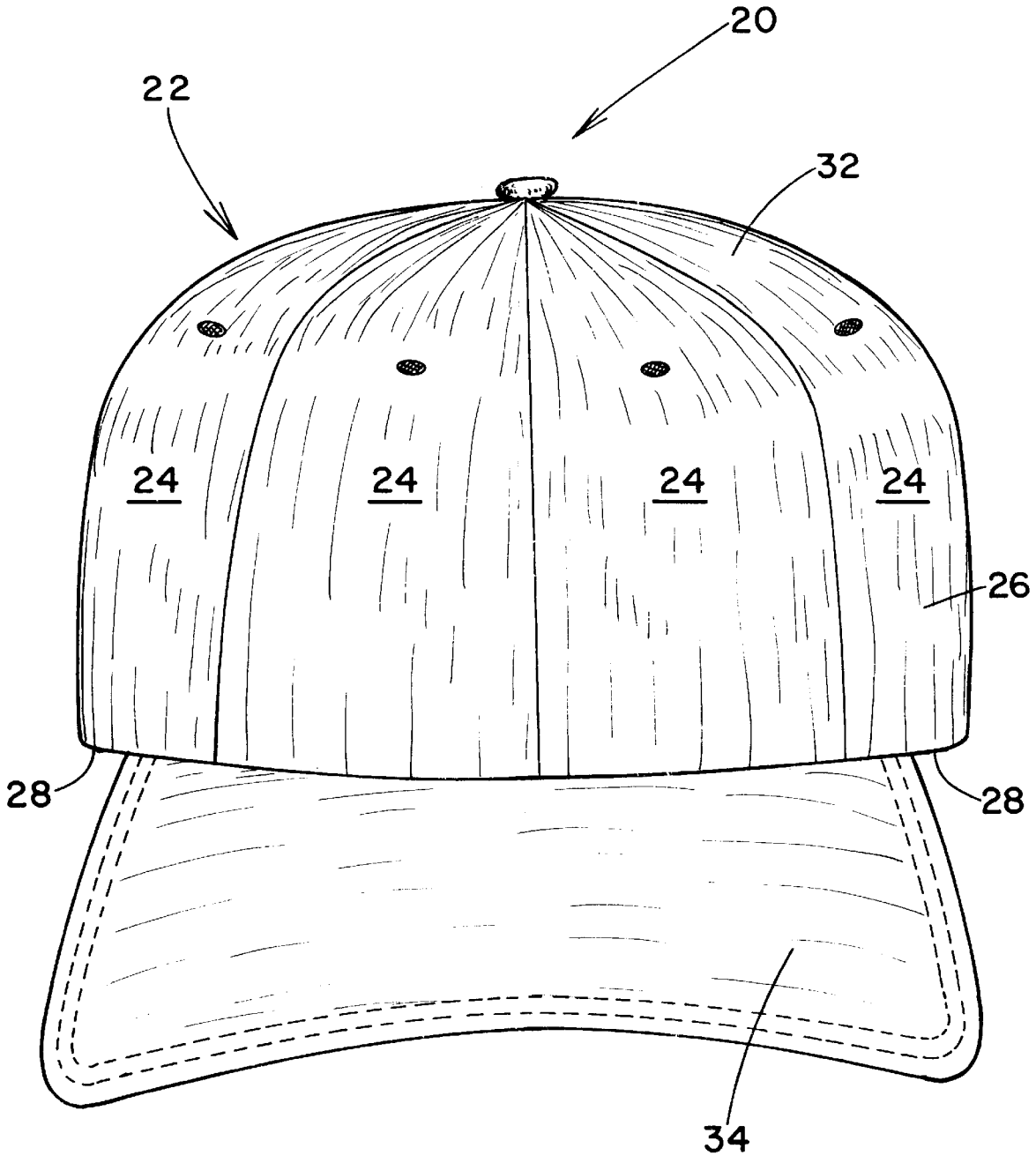
FIG. 3 is a plan front view of the headwear piece with the rear crown seam closed.
Figure 4:
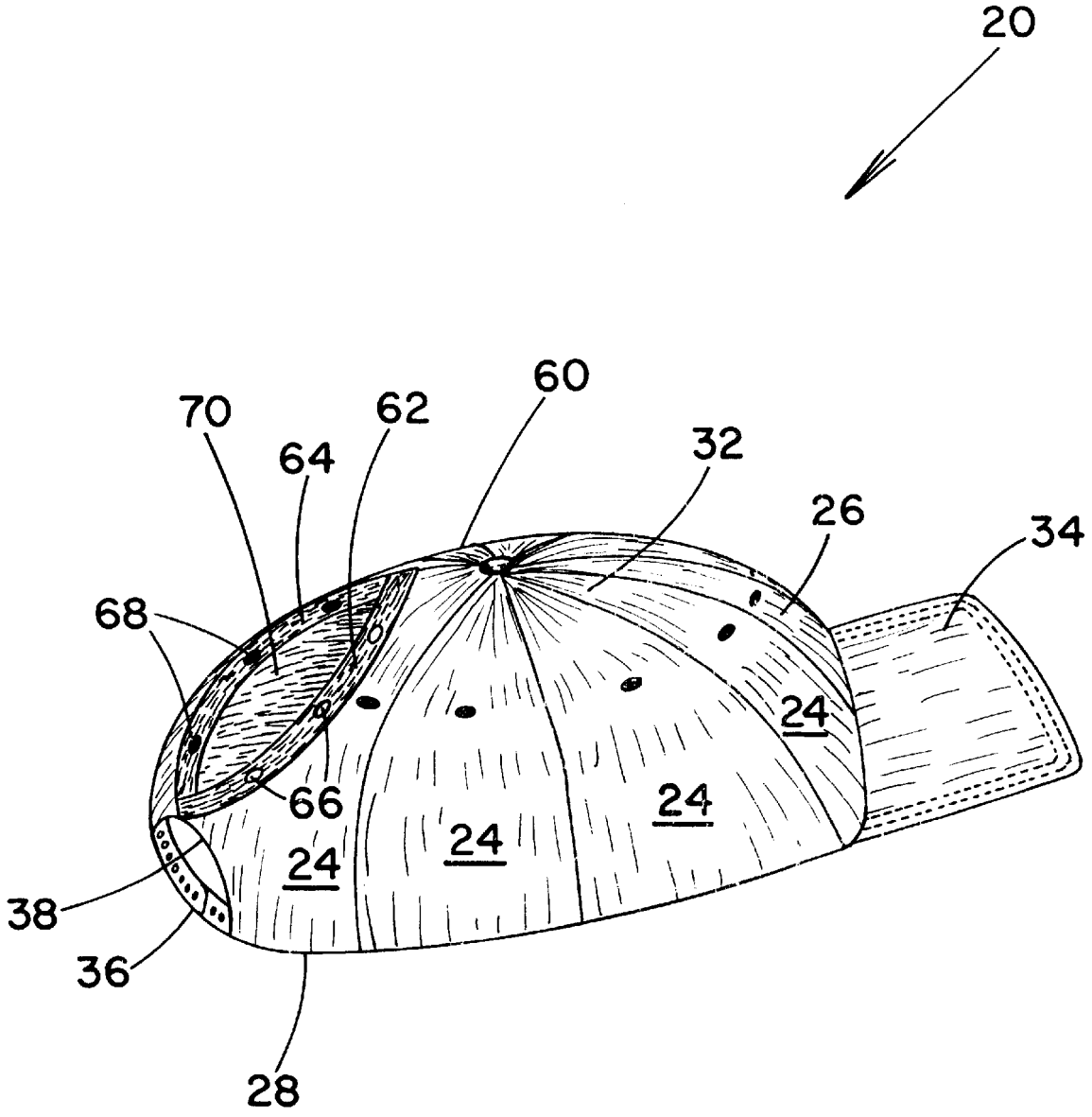
FIG. 4 is a perspective side view of the headwear piece with the rear crown seam open.
Figure 5:
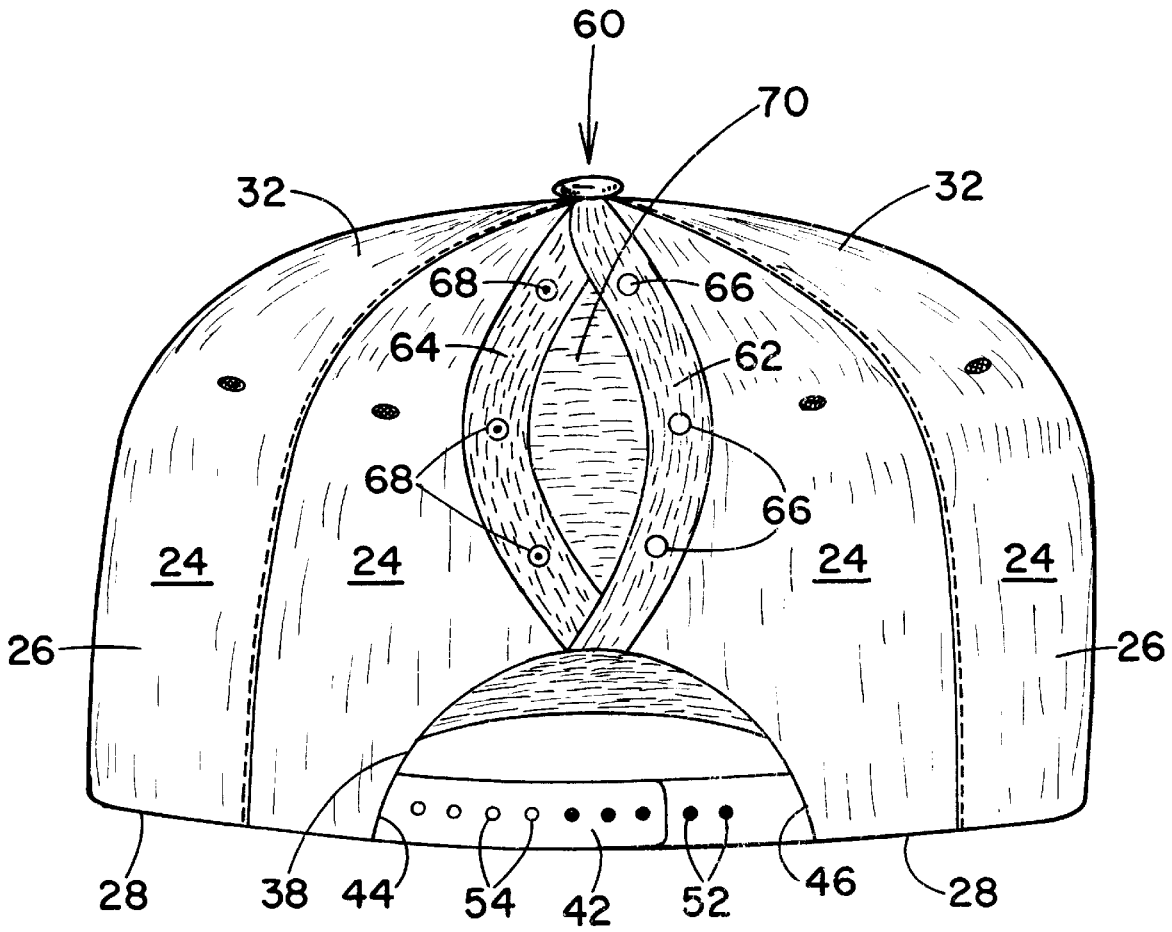
FIG. 5 is a plan rear view of the headwear piece with the rear crown seam open.

20 Headwear Piece
22 Crown
24 Gores or Panels
26 Peripheral Wall
28 Bottom Edge of Headwear
30 Opening of Headwear
32 Top Wall of Headwear
34 Rim or Bill of Headwear

36 Size Adjustment Structure
38 U-Shaped Cutout Aperture
40 Rear of Headwear
42 Adjusting Strap
44 Edge of Cutout Aperture
46 Edge of Cutout Aperture
48 Cooperating Parts of Adjusting Strap
50 Cooperating Parts of Adjusting Strap
52 Studs
54 Receptacles
60 Rear Crown Seam
62 Overlapping Portion of Panels
64 Overlapping Portion of Panels
66 Fastening Means on Panel Overlapping Portion
68 Fastening Means on Panel Overlapping Portion
70 Closeable Aperture of Rear Crown Seam
A Accumulated Hair of Wearer
H Head of Wearer

Construction

As mentioned above, an unmet need is seen for a headwear piece which provides a neat and attractive passage at the upper back portion of the item, for the passage of the hair of a longer hairstyle there through.

The headwear piece 20 of the present invention overcomes the problems described above for many of the prior art headwear pieces. The headwear piece 20 has a crown 22 defined by joined gores/panels 24 to produce an inverted, cup-shaped configuration to accommodate the head H of the wearer. The panels 24 cooperatively define a peripheral wall 26 with a bottom edge 28 defining an opening 30 to accommodate the head H of the wearer. The peripheral wall 26 blends into the top wall 32.

A rim/bill 34 projects forward and downward from the bottom edge 28 of the crown 22 as in the prior art headwear pieces. While the headwear piece 20 is shown to be a baseball-style cap, it should be understood that the invention contemplates incorporation into any headwear piece having a crown. For example, the bill/rim 34 may extend continuously about the bottom edge 28 of the crown 22 or might be eliminated altogether.

Size adjustment structure is provided at 36. An inverted U-shaped cutout aperture 38 is provided at the rear 40 of the headwear piece 20. An adjusting strap 42 connects to opposite edges 44, 46 bounding the cutout aperture 38. The strap 42 has cooperating parts 48, 50 that have complementary studs 52 and receptacles 54 that are made so as to select the overall effective length of the adjusting strap 42. By increasing the amount of overlap of the strap portions 48, 50, the effective length of the strap 42 is reduced, which draws the edges 44, 46 towards each other to diminish the diameter of the crown opening 30.

According to the invention, the crown 22 of the headwear piece 20 contains a rear crown seam 60 between two panels 24 that is not permanently fastened together, as opposed to the seams between the other panels 24 which are permanently fastened together. Each panel 24 adjacent the seam 60 has an overlapping portion 62, 64 at the unfastened seam 60. The seam 60 extends from the crown top wall 32 and down through at least a portion of the crown peripheral wall 26. The unfastened seam 60 stops short of the bottom edge 28 of the headwear or the size adjusting structure 36, if present. This construction allows the bottom edge 28 of the headpiece 20 to maintain a preselected size to securely fit on the wearer's head H.

The overlapping panel portions 62, 64 contain reversible fastening means 66, 68 such that the aperture 70 formed between the adjacent panels 24 may be selectively opened or closed. The fastening means may be a plurality of snaps, hooks, button and button holes, a zipper, or strips of hook and loop fastening tape. These fastening means 66, 68 are positioned to be in register between the panel overlapping portions 62, 64. The most preferred fastening means is a plurality of snap fasteners as shown in the Figures. One overlapping portion 62 contains snap studs 66, while the other overlapping portion 64 contains complimentary stud receptacles 68. The panels 24 that make up the crown 22 of the headwear piece 20 are composed of flexible, pliable material to allow the overlapping panel portions 62, 64 to flex sufficiently to separate and form an aperture 70 there between.

To position the headpiece 20 on the head of a wearer with an accumulation of hair A thereon, the seam fastening means 66, 68 are disengaged to produce the aperture 70 in the rear portion 40 of the crown 22. Since the aperture 70 extends vertically along the rear portion 40 of the crow 22, it is not critical where the hair accumulation A is located on the wearer's head H. The headpiece 20 can be adjusted for the desired fit on the on the wearer's head H with the hair accumulation A free to move relative to the aperture 70.

Figure 6:
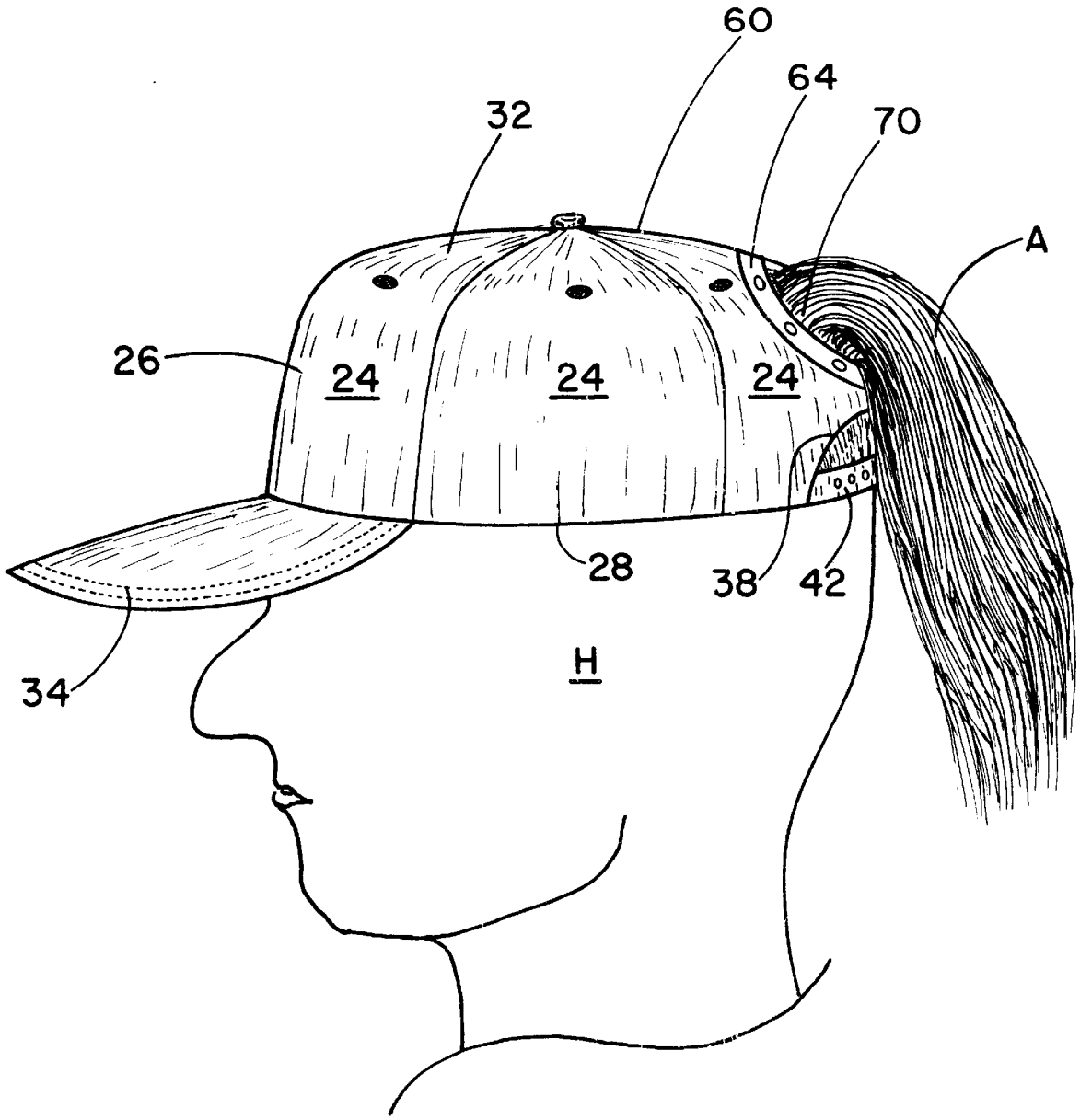
FIG. 6 is a perspective side view of the headwear piece with the rear crown seam open and on the head of a wearer with a ponytail.

As a result, the fit of the headwear piece 20 is not altered by the wearer's having a ponytail or similar accumulation of hair A. At the same time, there is no distortion of the crown 22 that occurs by reason of the accumulation of hair A in a ponytail as occurs with some prior art headwear pieces. Instead, the hair accumulation drapes over the back of the wearer's head H, as seen in FIG. 6.

Should the headwear piece wearer not have any hair accumulation A, the aperture 70 can be closed by connecting the fastening means 66, 68 on the overlapping panel portions 62, 64. The headwear piece 20 then functions as normal. The crown aperture 70, however, remains available for future use as needed. When not in use to accommodate the hair of the wearer, the closed rear crown seam 60 is essentially unnoted.

Figure 7:
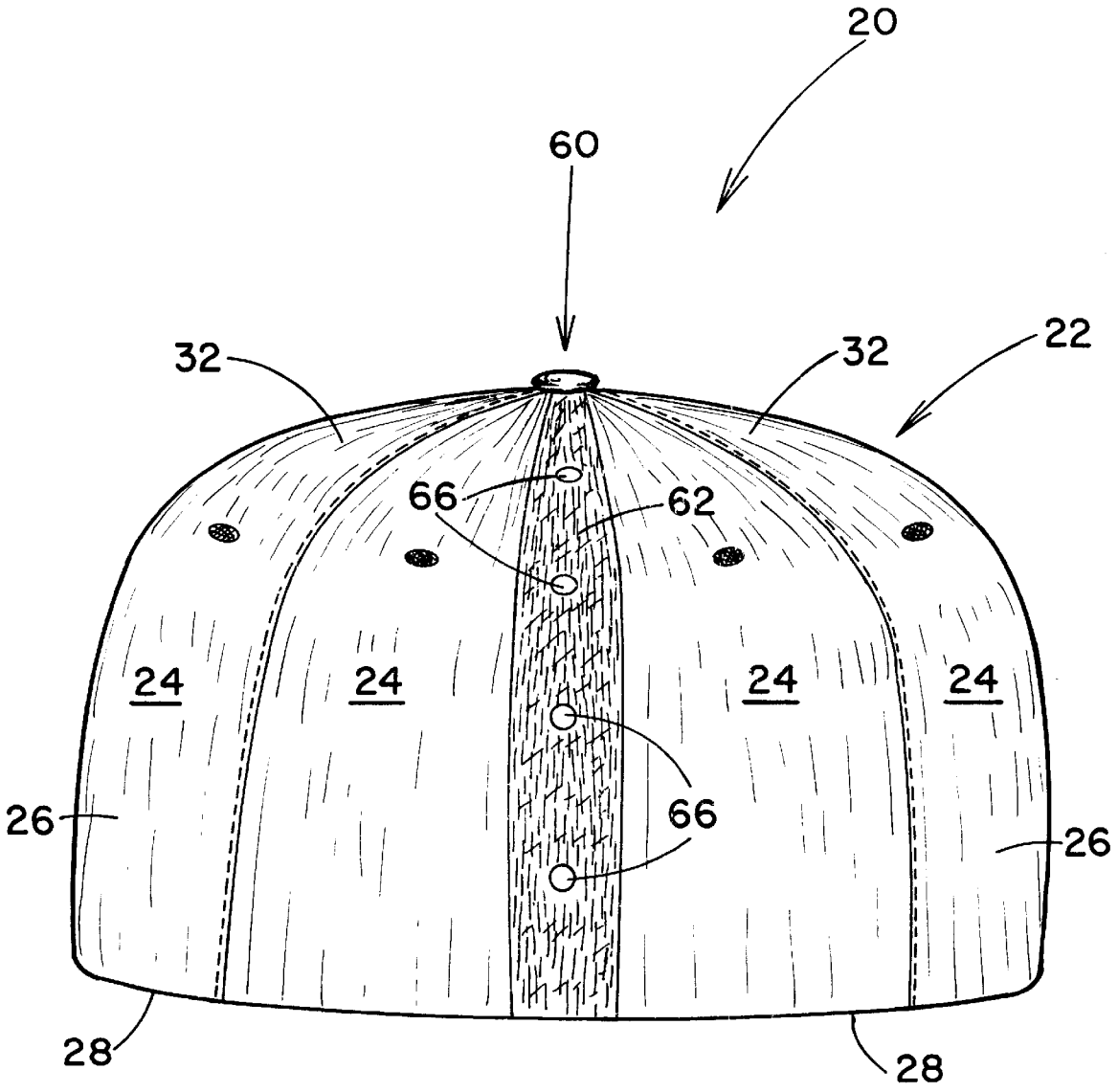
FIG. 7 is a plan rear view of another headwear piece with the rear crown seam closed.
Figure 8:
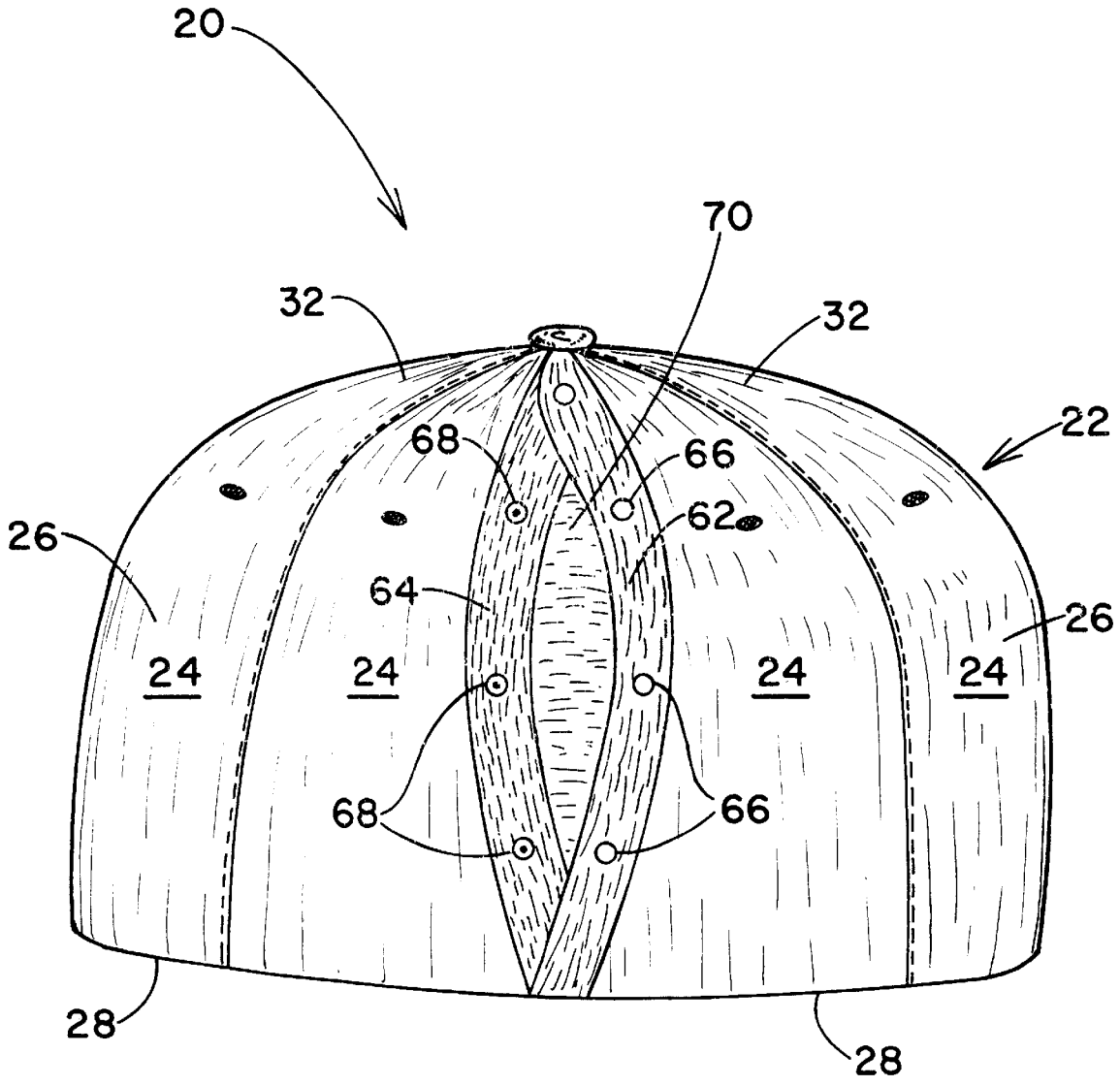
FIG. 8 is a plan rear view of another headwear piece with the rear crown seam open.

As mentioned above, the closable aperture 70 of the present invention is suitable for use with headwear pieces having a size adjusting structure 36, or for those without such a structure, as shown in FIGS. 7 and 8.

While the invention has been particularly shown and described with reference to a preferred embodiment thereof, it will be understood by those skilled in the art that various changes in form and details may be made therein without departing from the spirit and scope of the invention.

We claim:

1. A headwear piece comprising;

a) a crown defining an opening to accept the head of a wearer and having a front portion and a rear portion, said crown dimensioned to extend from the back to the front of a wearer's head, said crown having a top and a bottom, a peripheral wall having an annular configuration and a top wall;

b) said crown having at least one unfastened crown seam with overlapping portions, said unfastened crown seam extending from said top wall and through at least a portion of said crown peripheral wall at the rear portion of said crown; and c) means to reversibly fasten said rear crown seam overlapping portions together, whereby a wearer may insert an accumulation of hair through said unfastened crown seam with said headwear piece positioned on the wearer's head.

2. The headwear piece according to claim 1 wherein said unfastened crown seam is oriented vertically on said headwear piece.

3. The headwear piece according to claim 1 wherein said unfastened crown seam terminates short of said crown bottom.

4. The headwear piece according to claim 1 wherein said crown seam fastening means is selected from the group consisting of snaps, buttons and button holes, zippers, hook and loop tape, and hooks.

5. The headwear piece according to claim 1 wherein said crown seam fastening means is most preferably snaps.

6. The headwear piece according to claim 1 further comprising a bill member fastened to said bottom of said crown front portion.

7. The headwear piece according to claim 1 further comprising a rim member fastened completely around said bottom of said crown.

8. The headwear piece according to claim 1 wherein said crown and overlapping portions thereof are fabricated from a flexible material.

9. A headwear piece comprising;

a) a crown defining an opening to accept the head of a wearer and having a front portion and a rear portion, said crown dimensioned to extend from the back to the front of a wearer's head, said crown having a top and a bottom, a peripheral wall having an annular configuration and a top wall;

b) a bill member extending angularly from said crown front portion;

c) means positioned in the crown rear portion for adjusting the crown bottom dimension to accommodate different head sizes;

d) said crown having at least one unfastened crown seam with overlapping portions, said unfastened crown seam extending from said top wall and through at least a portion of said crown peripheral wall at the rear portion of said crown; and e) means to reversibly fasten said rear crown seam overlapping portions together, whereby a wearer may insert an accumulation of hair through said unfastened crown seam with said headwear positioned on the wearer's head.

10. The headwear piece according to claim 9 wherein said unfastened crown seam is oriented vertically on said headwear piece.

11. The headwear piece according to claim 9 wherein said unfastened crown seam terminates short of said crown bottom dimension adjusting means.

12. The headwear piece according to claim 9 wherein said crown seam fastening means is selected from the group consisting of snaps, buttons and button holes, zippers, hook and loop tape, and hooks.

13. The headwear piece according to claim 9 wherein said crown seam fastening means is most preferably snaps.

14. The headwear piece according to claim 9 wherein said crown bottom dimension adjusting means comprises an adjusting strap connected between opposite edges of a U-shaped cutout aperture positioned at said crown bottom edge of said crown rear portion.

15. The headwear piece according to claim 14 wherein said adjusting strap connected between opposite edges of a U-shaped cutout aperture comprises cooperating parts, one having complementary studs and one having complementary receptacles reversibly mated to selectively vary the adjusting strap length.

16. The headwear piece according to claim 9 wherein said crown and overlapping portions thereof are fabricated from a flexible material.

* * * * *